US008250886B2

(12) United States Patent
Lim et al.

(10) Patent No.: US 8,250,886 B2
(45) **Date of Patent: *Aug. 28, 2012**

(54) WASHING-DRYING/DRYING MACHINE

(75) Inventors: Hee Tae Lim, Kyungki-do (KR); Sang Wook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/052,453

(22) Filed: Mar. 21, 2011

(65) Prior Publication Data

US 2011/0167663 A1 Jul. 14, 2011

Related U.S. Application Data

(63) Continuation of application No. 11/346,206, filed on Feb. 3, 2006, now Pat. No. 7,921,681.

(30) Foreign Application Priority Data

Feb. 3, 2005 (KR) ..... 10-2005-0010140

(51) Int. Cl.
*D06F 25/00* (2006.01)
*D06F 29/00* (2006.01)

(52) U.S. Cl. ..... 68/20; 68/142; 68/207

(58) Field of Classification Search ..... 68/19.1, 68/20, 140, 142, 207
See application file for complete search history.

(56) References Cited

U.S. PATENT DOCUMENTS

| | | | |
|---|---|---|---|
| 2,644,245 | A | 7/1953 | Hammell, et al. |
| 2,717,456 | A | 9/1955 | Smith |
| 3,012,333 | A | 12/1961 | Leonard |
| 3,102,407 | A | 9/1963 | Stillwell, Jr. |
| 4,024,735 | A | 5/1977 | Marchiselli |
| 4,112,590 | A | 9/1978 | Muller |
| 7,421,865 | B2 | 9/2008 | Lee et al. |
| 2003/0233854 | A1 | 12/2003 | Matsuda et al. |
| 2004/0118167 | A1 | 6/2004 | Kim et al. |
| 2004/0250442 | A1 | 12/2004 | Ryu |

FOREIGN PATENT DOCUMENTS

| | | |
|---|---|---|
| DE | 6600687 | 1/1969 |
| DE | 6602473 | 6/1969 |
| DE | 2 304 526 | 8/1974 |
| EP | 0 969 132 | 1/2000 |
| EP | 1 554 342 | 6/2005 |
| FR | 2 711 153 | 4/1995 |
| JP | 06063296 A | 3/1994 |
| JP | 2003-062384 | 3/2003 |
| KR | 10-2002-0090872 | 12/2002 |
| KR | 1995-25060 | 9/2005 |

OTHER PUBLICATIONS

U.S. Office Action dated Apr. 15, 2011 for U.S. Appl. No. 13/052,474.

Korean Office Action dated Jun. 30, 2006.

U.S. Office Action dated Oct. 17, 2011 for U.S. Appl. No. 13/052,474.

*Primary Examiner* — Joseph L Perrin

(74) *Attorney, Agent, or Firm* — KED & Associates, LLP

(57) ABSTRACT

A washing-drying/drying machine includes a tub mounted in a cabinet; a drum rotatably disposed in the tub for receiving laundry; a cooling water supply unit for supplying cooling water to condense moisture in air discharged from the drum; and a condensing plate mounted between the drum and an inner wall of the tub for receiving the cooling water to condense the moisture in the air.

17 Claims, 6 Drawing Sheets

WASHING-DRYING/DRYING MACHINE

CROSS-REFERENCE TO RELATED APPLICATION

This application is a Continuation of U.S. patent application Ser. No. 11/346,206, filed in the U.S. on Feb. 3, 2006, which claims priority to Korean Patent Application No. 10-2005-0010140 filed in Korea on Feb. 3, 2005, the entire contents of which are hereby incorporated by reference.

BACKGROUND OF THE INVENTION

1. Field of the Invention

The present invention relates to a washing-drying/drying machine, and, more particularly, to a washing-drying/drying machine that is capable of condensing moisture in the air in the course of drying laundry in a tub.

2. Description of the Related Art

Generally, laundry drying machines are machines that dry clothes or the like (hereinafter referred to as "laundry"). Based on the function, the laundry drying machines are classified into a washing-drying machine that washes and dries the laundry and a drying machine that only dries the laundry.

FIG. 1 is a longitudinal sectional view showing an example of a conventional washing-drying machine.

As shown in FIG. 1, the conventional washing-drying machine comprises: a cabinet 2; a tub 10 mounted inside the cabinet for receiving wash water; a drum 20 rotatably disposed in the tub 10 for receiving laundry m; and a motor 30 for rotating the drum 20 while supporting the drum 20.

The cabinet 2 is provided at the front surface thereof with a laundry inlet/outlet hole 3, through which the laundry m is put into or removed from the cabinet 2. At the front surface of the cabinet 2 is mounted a door for opening and closing the laundry inlet/outlet hole 3.

The door 4 comprises: a door frame 4*a* hingedly connected to the front surface of the cabinet 2; and a door glass 4*b* attached to the door frame 4*a* while protruding in a convex shape toward the rear of the door frame 4*a*.

The tub 10 is mounted in the cabinet 2 while being suspended by springs 5 connected to the top part of the cabinet 2. Also, the tub 10 is supported by a damper 6, which is mounted at the bottom part of the cabinet 2, in a shock-absorbing fashion.

To the tub 10 is connected a water supply unit 12 for supplying wash water introduced from the outside into the tub 10. To the tub 10 is also connected a water draining unit 14 for draining wash water in the tub 10 out of the washing-drying machine.

The tub 10 is provided at the center of the front surface thereof with a tub-side opening hole 15, through which the laundry m and air is introduced into or discharged from the tub 10. To the front surface of the tub 10 is attached a gasket 16, which comes into tight contact with the door 4, when the door 4 is closed, for preventing the laundry m, the wash water, and the air from being discharged from a gap between the tub 10 and the door 4.

At the center of the front surface of the drum 20 is formed a drum-side opening hole 21, through which the laundry m and air are introduced into or discharged from the drum 20. At the circumferential surface or the rear surface of the drum 20 are formed a plurality of through-holes 22, through which wash water and air are introduced into or discharged from the drum 20.

To the inner wall of the drum 20 are attached lifters 23, by which the laundry m is lifted and then falls.

The motor 30 has a rotary shaft extending through the tub 10 such that the rotary shaft is supported by bearings in the tub 10. The front end of the rotary shaft is connected to the rear surface of the drum 20.

The washing-drying machine further comprises: a drying duct 43, having a circulating fan 41 and a heater 42, for supplying a hot wind into the drum 20; and a condenser 46 for condensing the moisture in the air in the course of drying the laundry m in the drum 20 and guiding the condensed air to the drying duct 43.

In the drying duct 43 is mounted a fan motor 44 for rotating the circulating fan 41.

The outlet end of the drying duct 43 is fixedly inserted into or fitted onto a drying duct connection member 18, which is formed at the gasket 16.

The condenser 43 comprises: a condensing duct 47 connected to the side part of the rear part of the tub 10 for allowing air discharged from the tub 10 to pass therethrough; and a cooling water supply unit 48 for supplying cooling water into the condensing duct 47 such that the air passing through the condensing duct 47 is cooled by the cooling water and thus condensed.

The lower end of the condensing duct 47 is connected to the side part of the rear part of the tub 10 at right angles, and the upper end of the condensing duct 47 is connected to the drying duct 43. The condensing duct 47 is disposed between the tub 10 and the cabinet 2 vertically or while being inclined.

The operation of the conventional washing-drying machine with the above-stated construction will be described hereinafter.

When a user puts the laundry m into the drum 20, closes the door 4, selects a washing operation, and operates the washing-drying machine, wash water is introduced into the cabinet 2 through the water supply unit 12.

The introduced wash water is supplied into the tub 10, and is then introduced into the drum 20 through the through-holes 22 of the drum 20 such that the laundry m is wetted by the wash water.

As the motor 30 is operated after the above-described water supply is completed, the drum 20 is rotated, and as a result, the laundry m is shaken in the drum 20, and pollutants are separated from the laundry m by the action of the wash water.

After the above-described washing process is completed, the contaminated wash water in the tub 10 is drained out of the washing-drying machine through the water draining unit 14.

If a rinsing operation is selected by the user, the rinsing process is performed several times for rinsing bubbles from the laundry m. The water supply unit 12 and the motor 30 are controlled in the same fashion as the washing operation such that bubbles are rinsed out of the laundry m, and the contaminated wash water containing the bubbles is drained out of the washing-drying machine through the water draining unit 14.

If a spin-drying operation is selected by the user, the motor 30 is controlled to rotate the drum 20 at high speed. As a result, the laundry m in the drum 20 is pushed against the inner wall of the drum 20, and therefore, the moisture is centrifugally separated from the laundry m.

If a drying operation is selected by the user, the drum 20 is rotated by the motor 30, the circulating fan 41 is also rotated, and the drying heater 42 is turned on. Also, the cooling water is supplied through the cooling water supply unit 48.

The cooling water supplied through the cooling water supply unit 48 falls into the condensing duct 47, and the air used to dry the laundry m in the drum 20, i.e., the low-temperature and high-humidity air, is introduced into the condensing duct 47 through the through-holes 22 of the drum 20 and the tub 10 by the rotation of the circulating fan 41. The air is condensed by the cooling water while passing through the condensing duct 47.

After passing through the condensing duct 47, the air passes through the drying duct 43. At this time, the air is heated by the heater 42, and as a result, the air is changed into a hot wind. The hot wind passes through the drying duct connection member 18 of the gasket 16, and is then discharged to the inside of the gasket 16. Thereafter, the hot wind strikes the door glass 4*b* of the door 4, and is blown to the drum 20. The laundry m is dried in the drum 20 by the blown hot wind, and as a result, the hot wind is changed into low-temperature and high-humidity air.

In the conventional washing-drying machine with the above-state construction, however, the capacities of the tub 10 and the drum 20 are decreased because of the condensing duct 47, or the size of the cabinet 2 is increased. Also, the flow resistance due to the condensing duct 37 is 30% to 50% of the total resistance, which is undesirable.

Furthermore, the cooling water supplied to the condensing duct 47 quickly passes through the condensing duct 47. Consequently, condensing efficiency is lowered, and a large amount of cooling water is wasted.

SUMMARY OF THE INVENTION

Therefore, the present invention has been made in view of the above problems, and it is an object of the present invention to provide a washing-drying/drying machine that is capable of condensing air used to dry laundry in a tub, thereby increasing capacities of the tub and a drum or decreasing the overall size of the washing-drying/drying machine, and capable of minimizing flow resistance, thereby improving drying efficiency and reducing drying time.

In accordance with the present invention, the above and other objects can be accomplished by providing of a washing-drying/drying machine comprising: a tub mounted in a cabinet; a drum rotatably disposed in the tub for receiving laundry; a cooling water supply unit for supplying cooling water to condense moisture in air discharged from the drum; and a condensing plate mounted between the drum and an inner wall of the tub for receiving the cooling water to condense the moisture in the air.

In an embodiment, the condensing plate has a cooling water channel, which is defined between the condensing plate and the inner wall of the tub.

In an embodiment, the condensing plate includes a front bent part at a front end of the condensing plate and a rear bent part at a rear end of the condensing plate, and the front bent part and the rear bent part are in contact with the inner wall of the tub.

In an embodiment, the tub has bosses, to which the condensing plate is fixed by screws.

In an embodiment, the condensing plate has a main body; the main body is spaced apart from the inner wall of the tub by a gap; and the gap between the inner wall of the tub and the main body is equal to or greater than a predetermined value such that the cooling water freely falls between the condensing plate and the inner wall of the tub.

In an embodiment, the condensing plate has a main body; the main body is spaced apart from the inner wall of the tub by a gap, and the gap between the inner wall of the tub and the main body is less than a predetermined value such that the cooling water is collected between the condensing plate and the inner wall of the tub due to surface tension; and the collected cooling water falls down when new cooling water is introduced into a space between the condensing plate and the inner wall of the tub.

In an embodiment, the condensing plate has cooling water guide members, by which the cooling water is drained after uniformly cooling the condensing plate.

In an embodiment, the cooling water guide members are formed to guide the cooling water in a serpentine fashion.

In an embodiment, the cooling water guide members include at least one front-side cooling water guide member inclined downward from the front end of the condensing plate toward the rear end of the condensing plate, the lower ends of the front-side cooling water guide members being spaced apart from the rear end of the condensing plate; and at least one rear-side cooling water guide member inclined downward from the rear end of the condensing plate toward the front end of the condensing plate, the lower ends of the rear-side cooling water guide members being spaced apart from the front end of the condensing plate.

In an embodiment, the condensing plate is provided with embossed parts.

In an embodiment, the cooling water supply unit is mounted at one side of the tub for supplying the cooling water to the tub. The condensing plate, which is cooled by the cooling water, is mounted at the inner wall of the tub. The moisture in the air used to dry the laundry is condensed in the tub by the condensing plate. Consequently, it is unnecessary to mount an additional condensing duct at the outside of the tub. Therefore, the capacities of the tub and the drum are increased or the overall size of the washing-drying/drying machine is decreased. Furthermore, the flow resistance of the air used to dry the laundry is minimized. Therefore, the drying efficiency of the washing-drying/drying machine is improved while drying time is reduced.

In an embodiment, the air used to dry the laundry comes into contact with the condensing plate, which has a predetermined surface area. As a result, the moisture in the air is condensed. Consequently, a large amount of moisture is quickly condensed, and consumption of the cooling water is minimized.

In an embodiment, the front and rear ends of the condensing plate are bent such that front and rear ends of the condensing plate are disposed in contact with the inner wall of the tub. As a result, the cooling water supplied between the condensing plate and the inner wall of the tub is not mixed with air flowing in the tub. Therefore, the cooling water is not dispersed. Consequently, poor drying efficiency, which may be caused when the cooling water is dispersed, is effectively prevented.

In an embodiment, the condensing plate is provided with the bosses, through which the corresponding screws are threadedly inserted. Consequently, the condensing plate is easily and securely fixed to the tub.

In an embodiment, the cooling water supplied to one side of the tub freely falls between the condensing plate and the inner wall of the tub. Consequently, a large amount of cooling water rapidly passes between the condensing plate and the inner wall of the tub, and therefore, the moisture contained in the air is quickly condensed.

In an embodiment, the cooling water supplied to one side of the tub is collected between the condensing plate and the inner wall of the tub due to surface tension. As a result, the cooling water in the tub can be kept on the condensing plate longer. Therefore, consumption of the cooling water is minimized.

In an embodiment, the condensing plate is provided with the cooling water guide members, which serve to guide the cooling water in a serpentine fashion between the condensing plate and the inner wall of the tub. As a result, the entire condensing plate is cooled by the cooling water. Consequently, the moisture is uniformly condensed on the entire surface of the condensing plate, and the moisture is more quickly condensed.

In an embodiment, the condensing plate is provided with the embossed parts. Consequently, heat transfer efficiency of the condensing plate is increased. Therefore, a large amount of moisture is quickly condensed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE ILLUSTRATED EMBODIMENTS

Figure 1:
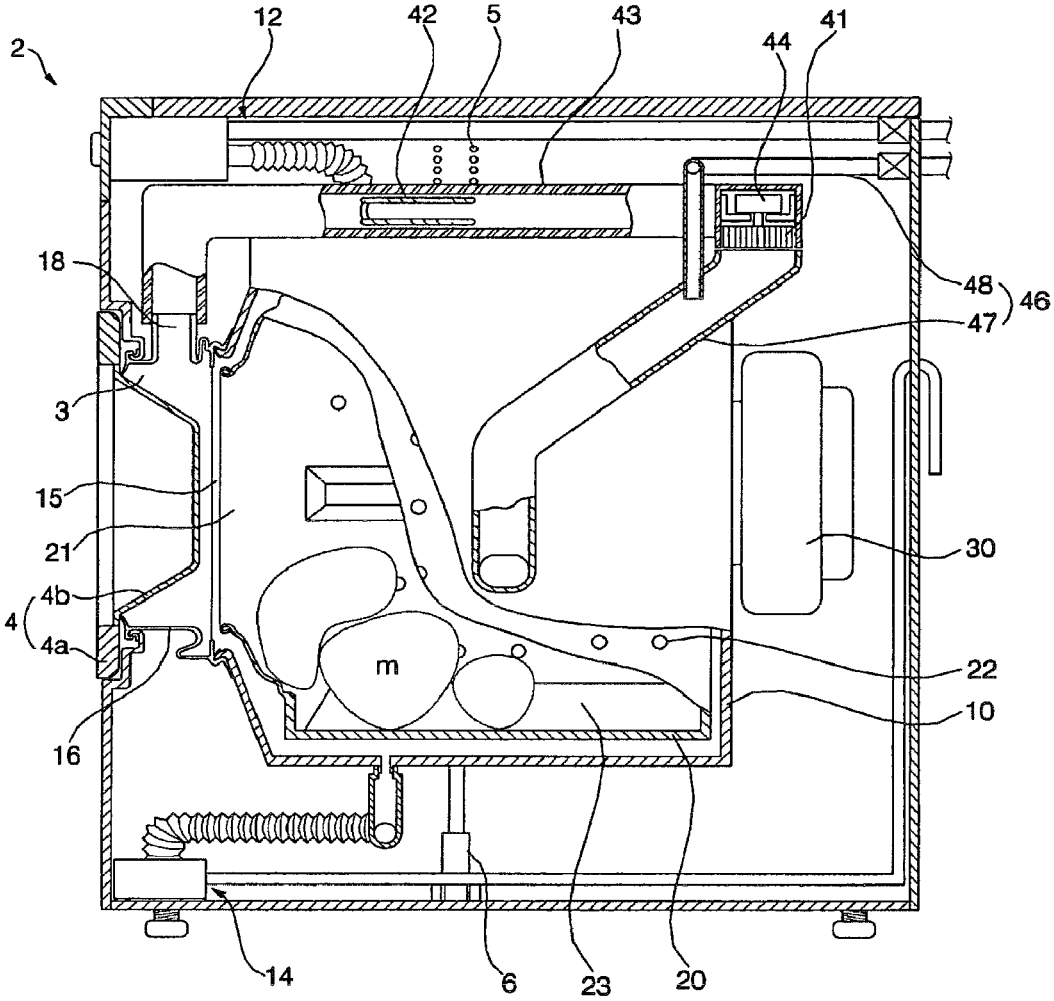
FIG. 1 (Related Art)
FIG. 1 is a longitudinal sectional view showing an example of a conventional washing-drying machine.

Embodiments of the present invention will be described in detail with reference to the accompanying drawings. The same or similar elements are denoted by the same reference numerals even though they are depicted in different drawings, and a detailed description thereof will be omitted.

Figure 2:
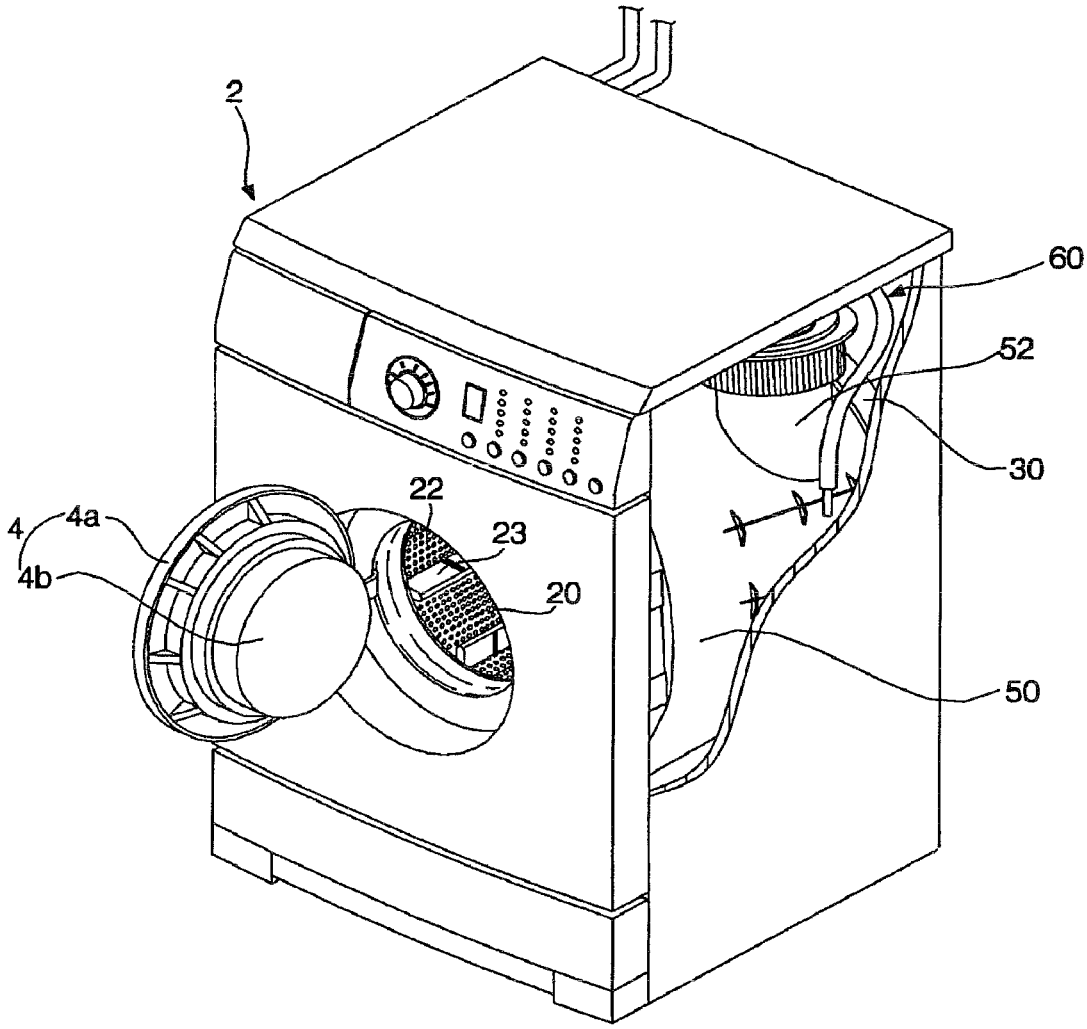
FIG. 2 is a partially-cutaway perspective view showing a washing-drying/drying machine according a preferred embodiment of the present invention.
Figure 3A:
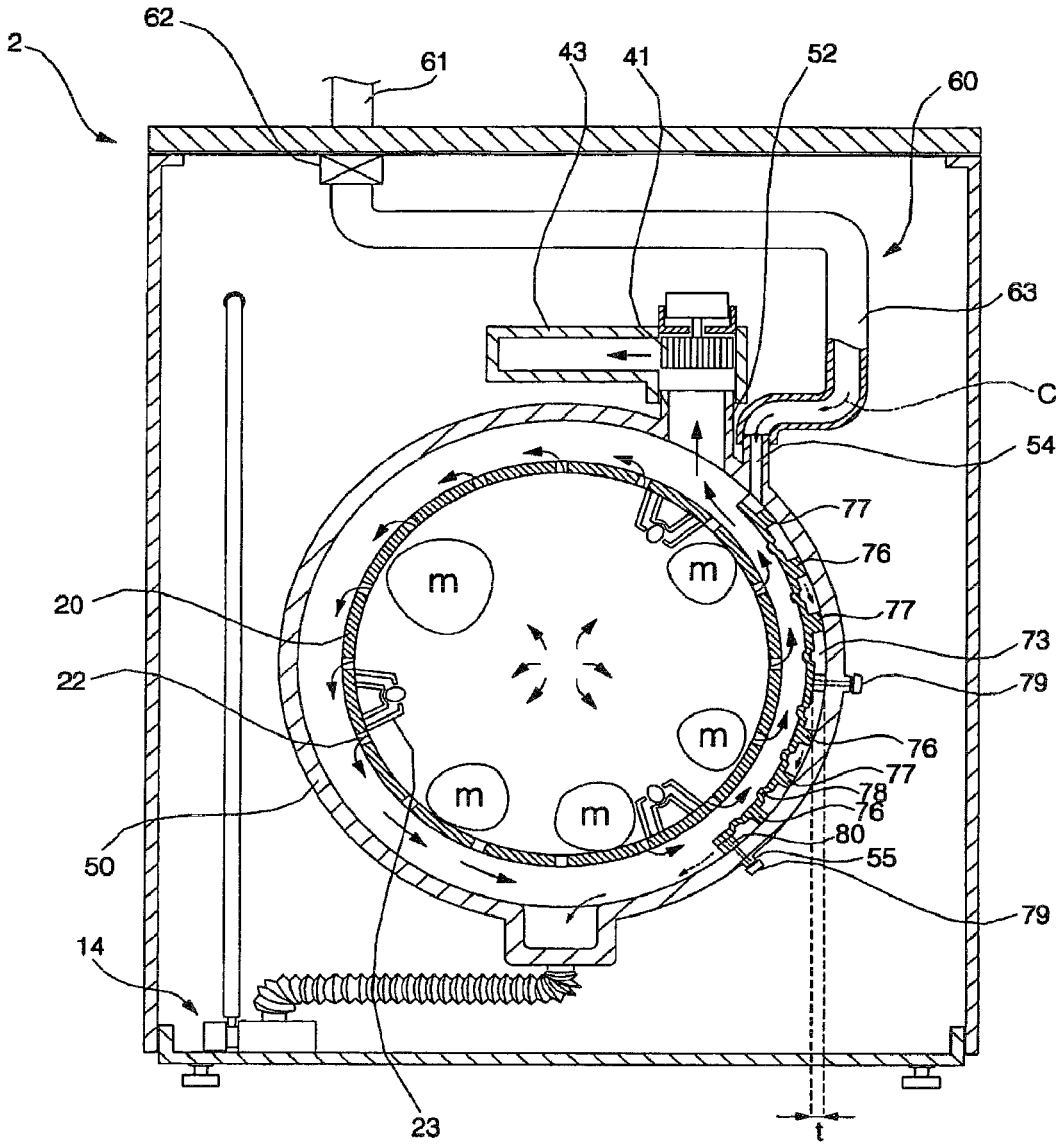
FIG. 3A is a cross-sectional view of the washing-drying/drying machine according a preferred embodiment of the present invention.

As shown in FIGS. 2 and 3A, a tub 50 is mounted in a cabinet 2, and a drum 20 is rotatably disposed in the tub 50 for receiving laundry.

Figure 4:
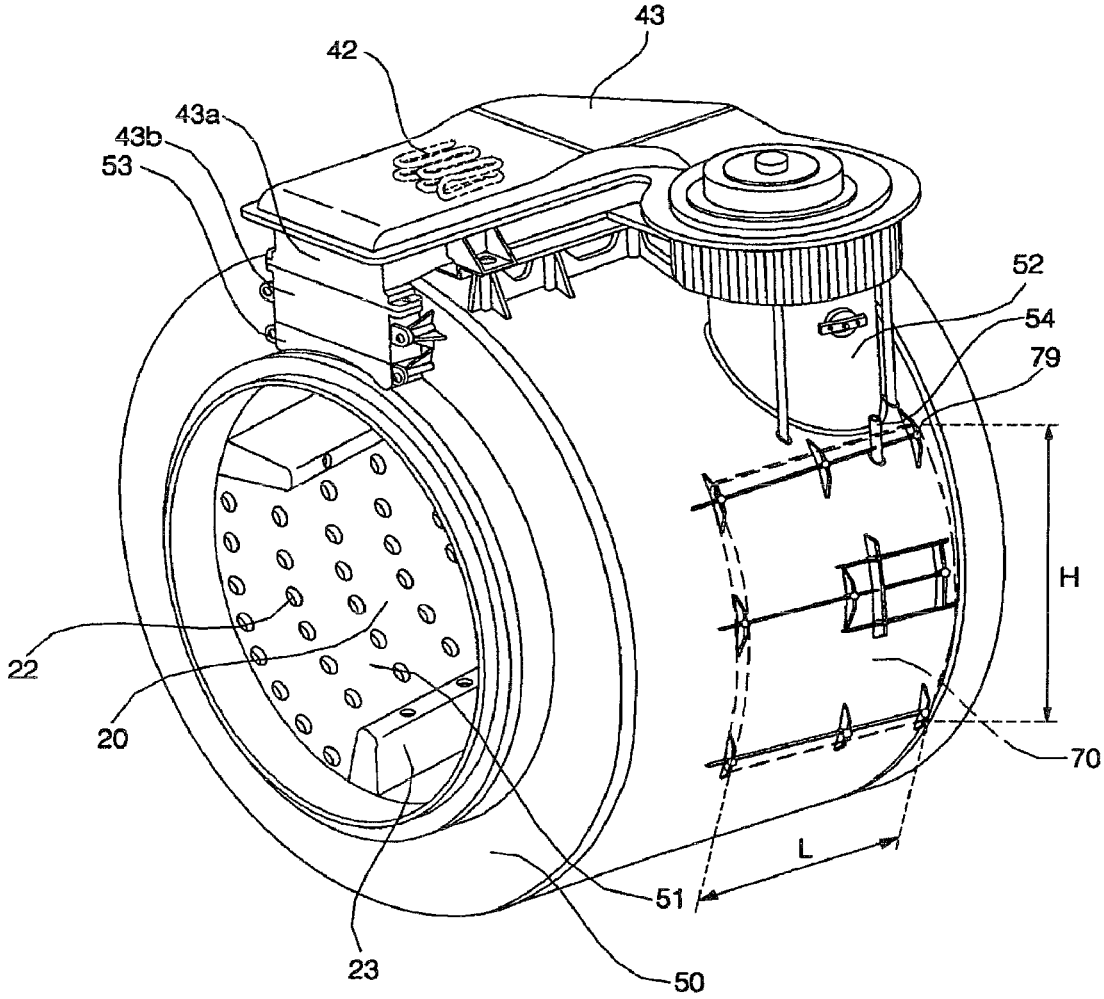
FIG. 4 is an enlarged perspective view of the tub shown in FIGS. 2 and 3A.

As shown in FIG. 4, the tub 50 has an opening hole 51 formed at the center of the front surface thereof and a first duct communicating member 52 formed at the right or left side of the upper part of the circumference thereof while protruding outward.

As shown in FIG. 3A, the first duct communicating member 52 is preferably formed at the tub 50 in the tangential direction such that the resistance of air introduced into the first duct communicating member 52 between the tub 50 and the drum 20 is minimized.

To the first duct communicating member 52 is directly connected a drying duct, in which a circulating fan 41 and a heater 42 are mounted, as shown in FIGS. 3A and 4.

The drying duct 43 has a front part 43*a* bent downward. The lower end of the front part 43*a* is connected to a drying duct connect connection member formed at a gasket 16 such that air heated by the heater 42 is supplied into the tub 50 through the drying duct connect connection member formed at the gasket 16. Also, the drying duct 43 may be connected to a second duct communicating member 53 formed at the upper part of the front surface of the tub 50 while the drying duct 43 communicates with the second duct communicating member 53 such that air heated by the heater 42 is directly supplied into the tub 50. Alternatively, the drying duct 43 may be connected to a connecting duct 43*b* mounted at the second duct communicating member 53 while the drying duct 43 communicates with the connecting duct 43*b* such that the air heated by the heater 42 is directly supplied into the tub 50 through the connecting duct 43*b*, as shown in FIG. 4.

To the tub 50 is connected a cooling water supply unit 60 for supplying cooling water C to one side of the tub 50.

As shown in FIGS. 3A and 4, the tub 50 has a cooling water supplying hole part 54 formed at one side thereof for allowing the cooling water C supplied through the cooling water supply unit 60 to be introduced into and through the tub. The cooling water supply unit 60 communicates with the cooling water supplying hole part 54.

The cooling water supplying hole part 54 is formed in the vicinity of the duct communicating member 52.

As shown in FIG. 3, the cooling water supply unit 60 comprises a cooling water valve 62 connected to an external hose 61 for allowing or interrupting introduction of the cooling water C from the external hose 61; and a cooling water hose 63 for guiding the cooling water C passing through the cooling water valve 62 to one side of the tub 50, especially, to the cooling water supplying hole part 54.

Inside the tub 50 is mounted a condensing plate 70 for condensing the moisture in the air A used to dry the laundry m. Specifically, the condensing plate 70 is mounted at the inner wall of the tub 50 such that the cooling water C supplied to one side of the tub 50 flows between the inner wall of the tub 50 and the condensing plate 70.

In an embodiment, the condensing plate 70 is mounted at the inner wall of the tub 50 under the duct communicating member 52 such that air condensed by the condensing plate 70 is directly introduced into the duct communicating member 52.

Also, the condensing plate 70 may be mounted at the inner wall of the tub 50 under the cooling water supplying hole part 54. Alternatively, the condensing plate 70 may be mounted at the inner wall of the tub 50 by the side of the cooling water supplying hole part 54. As shown in FIG. 3, the condensing plate 70 is mounted at the inner wall of the tub 50 under the cooling water supplying hole part 54.

As shown in FIG. 4, the condensing plate 70 has a predetermined height H such that the upper end of the condensing plate 70 is disposed under the cooling water supplying hole part 54, and the lower end of the condensing plate 70 is disposed at a predetermined position of the inner lower part of the tub 50.

As shown in FIG. 4, the condensing plate 70 also has a predetermined width L such that the front end of the condensing plate 70 is disposed more forward toward the front end of the tub 50 than the duct communicating member 52, and the rear end of the condensing plate 70 is disposed more rearward toward the rear end of the tub 50 than the duct communicating member 52.

As shown in FIGS. 2 and 3A, the condensing plate 70 is a plate that is bent in the same fashion as the inner wall of the tub 50. The condensing plate 70 may have a radius of curvature greater or less than that of the inner wall of the tub 50, or the condensing plate 70 may have a radius of curvature equal to that of the inner wall of the tub 50. In the illustrated embodiment, the condensing plate 70 has a radius of curvature equal to that of the inner wall of the tub 50.

At the lower end of the condensing plate 70 is formed a cooling water discharging port 72, which is spaced apart from the inner wall of the tub 50.

Between the condensing plate 70 and the inner wall of the tub 50 is defined a cooling water channel 73.

Figure 5:
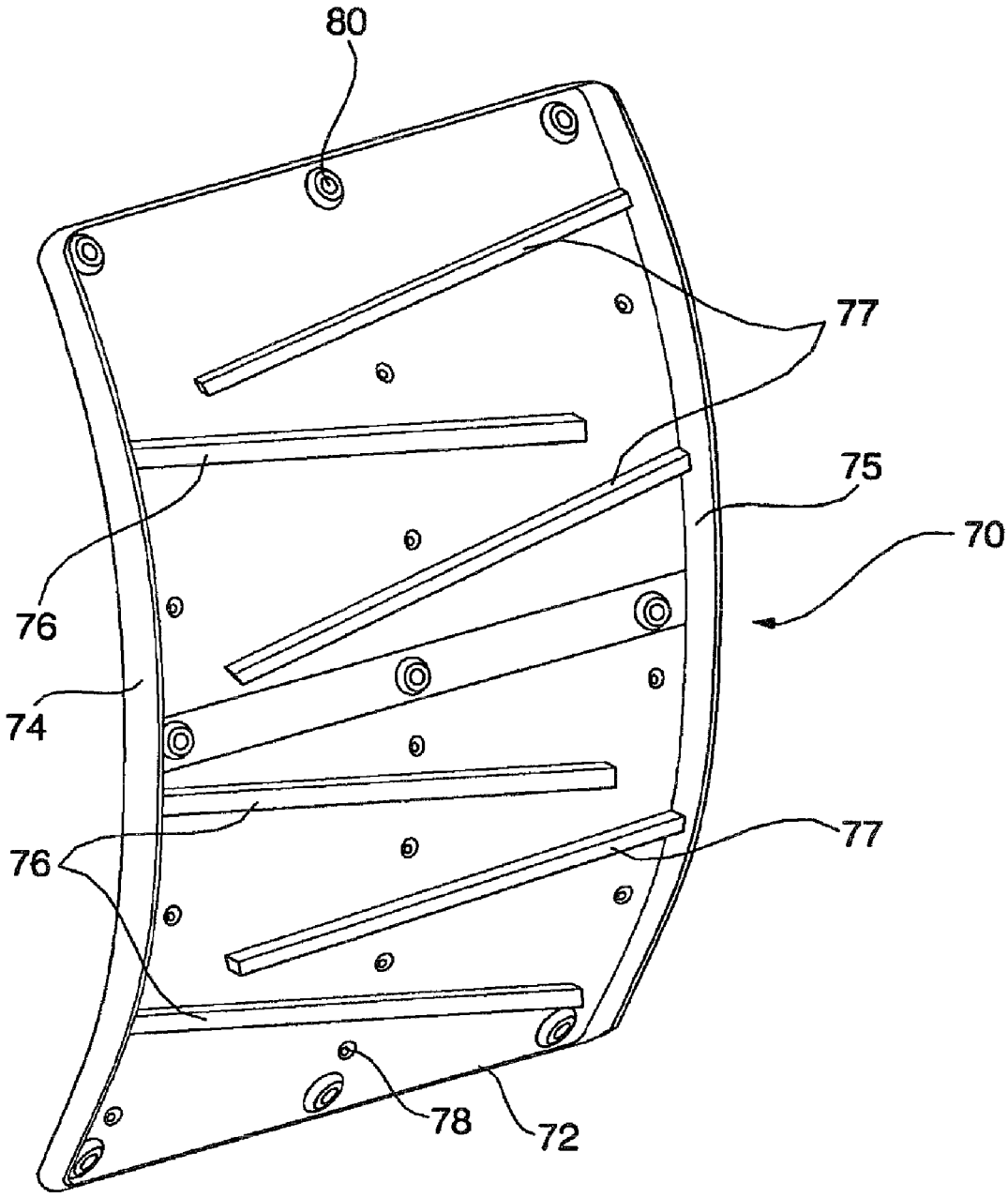
FIG. 5 is an enlarged perspective view of the condensing plate shown in FIG. 3A.

FIG. 5 is an enlarged perspective view of the condensing plate shown in FIG. 3A.

At the front end of the condensing plate 70 is formed a front bent part 74, which is disposed in contact with the inner wall of the tub 50. At the rear end of the condensing plate 70 is formed a rear bent part 75, which is disposed in contact with the inner wall of the tub 50 as shown in FIGS. 3 to 5. Therefore, the condensed water guided between the condensing plate 70 and the inner wall of the tub 50 is not mixed with air flowing in the tub 50. Accordingly, the condensed water is not dispersed.

The front bent part 74 and the rear bent part 75 are bent by a press.

The condensing plate 70 has a free falling structure or a surface tension utilizing structure based on a gap t (see Equation 1 below) between the main body of the condensing plate 70, i.e., the plate between the front bent part 74 and the rear bent part 75 of the condensing plate 70 and the tub 50.

The free falling structure is a structure in which the gap t between the inner wall of the tub 50 and the main body of the condensing plate 70 is equal to or greater than a predetermined value. Therefore, the cooling water falls between the condensing plate 70 and the inner wall of the tub 50 in the direction of gravity. The surface tension utilizing structure is a structure in which the gap t between the inner wall of the tub 50 and the main body of the condensing plate 70 is less than the predetermined value. Therefore, the cooling water is collected between the condensing plate 70 and the inner wall of the tub 50 due to surface tension, and the collected cooling water falls when new cooling water C is introduced into the space between the condensing plate 70 and the inner wall of the tub 50.

$$x = \frac{4r}{pght} \tag{1}$$

where, r is a surface tension constant (0.073), p is density of water, g is a coefficient of gravity, h is longitudinal length of the condensing plate, and t is a gap between the tub and the main body of the condensing plate.

If x is greater than 0.5, the condensing plate 70 has the free falling structure. Therefore, the cooling water falls between the condensing plate 70 and the inner wall of the tub 50 in the direction of gravity. If x is greater than 0 and not greater than 0.5, on the other hand, the condensing plate 70 has the surface tension utilizing structure. Therefore, the cooling water is collected between the condensing plate 70 and the inner wall of the tub 50 due to a surface tension, and the collected cooling water is introduced into between the condensing plate 70 and the inner wall of the tub 50.

At the condensing plate 70 are formed cooling water guide members 76 and 77, by which the cooling water C is drained after uniformly cooling the condensing plate 70.

The cooling water guide members 76 and 77 are formed at one side surface of the condensing plate 70 facing the inner wall of the tub 50, while protruding toward the inner wall of the tub 50.

Each of the cooling water guide members 76 and 77 has a height equal to the gap t. Therefore, the cooling water guide members 76 and 77 are disposed in contact with the inner wall of the tub 50.

Heat exchange between the cooling water C and the condensing plate 70 is performed while the cooling water C remains for a long period of time between the condensing plate 70 and the tub 50 by the cooling water guide members 76 and 77. In the illustrated embodiment as shown in FIG. 5, the cooling water guide members 76 and 77 are formed to guide the cooling water C in a serpentine fashion.

The cooling water guide members 76 and 77 comprise front-side cooling water guide members 76 inclined downward from the front bent part 74 of the condensing plate 70 toward the rear of condensing plate 70, the lower ends of the front-side cooling water guide members 76 being spaced apart from the rear bent part 75 of the condensing plate 70; and rear-side cooling water guide members 77 inclined downward from the rear bent part 75 of the condensing plate 70 toward the front of condensing plate 70, the lower ends of the rear-side cooling water guide members 77 being spaced apart from the front bent part 74 of the condensing plate 70.

The front-side cooling water guide members 76 are vertically arranged while being spaced apart from one another. Similarly, the rear-side cooling water guide members 77 are vertically arranged while being spaced apart from one another.

The front-side cooling water guide members 76 and the rear-side cooling water guide members 77 are alternately arranged such that front-side cooling water guide members 76 partially overlap with the corresponding rear-side cooling water guide members 77 in the vertical direction.

At the condensing plate 70 are formed embossed parts 78 for improving heat transfer efficiency of the condensing plate 70.

The embossed parts 78 may protrude either toward the center of the tub 50 or toward the inner wall of the tub 50. Alternatively, some of the embossed parts 78 may protrude inward, and the remaining embossed parts 78 may protrude outward.

The condensing plate 70 is securely fixed to the tub 50 by means of screws 79.

At the condensing plate 70 are formed bosses 80, which protrude toward the inner wall of the tub 50. The bosses 80 have fixing holes, through which the corresponding screws 79 are threadedly inserted. At the tub 50 are formed bosses 55, which have fixing holes corresponding to the fixing holes of the bosses 80 formed at the condensing plate 70.

The operation of the washing-drying/washing machine with the above-stated construction according to illustrated embodiments will be described in detail.

When the cooling water valve 62 is turned on, cooling water C introduced through the external hose 61 passes through the cooling water valve 62 and the cooling water hose 63, and is then supplied to the cooling water supplying hole part 54. The cooling water C supplied to the cooling water supplying hole part 54 flows downward, is introduced into the space between the condensing plate 70 and the inner wall of the tub 50, and then passes between the condensing plate 70 and the inner wall of the tub 50.

The cooling water C passing between the condensing plate 70 and the inner wall of the tub 50 flows downward in a serpentine fashion by the cooling water guide members 76 and 77 to absorb heat from the entire condensing plate 70, and is then discharged out of the condensing plate 70 through the cooling water discharging port 72 formed at the lower end of the condensing plate 70. Thereafter, the cooling water C is collected in the inner lower part of the tub 50, and is then drained out of the washing-drying/drying machine through the water draining unit 14.

When the drum 20 is rotated simultaneously with the above-described supply of the cooling water C, the laundry m received in the drum 20 is shaken in the drum 20. In the meantime, the circulating fan 41 rotates. Therefore, the air A in the drum 20 is blown toward the through-holes 22 of the drum 20 by the blowing pressure generated as the circulating fan 41 rotates.

The air A moving toward the through-holes 22 of the drum 20 comes into contact with the laundry m. At this time, heat exchange between the air A and the laundry m is performed. As a result, the air A is changed into low-temperature and high-humidity wet air. Subsequently, the low-temperature and high-humidity wet air passes through the through-holes 22 of the drum 20, and then flows between the drum 20 and the tub 50.

The wet air passes by the condensing plate 70, which is cooled by the cooling water C. Therefore, heat is transferred from the wet air to the condensing plate 70. As a result, the moisture is condensed on the condensing plate 70, and the wet air is changed into low-humidity air.

The low-humidity air passes through the duct communicating member 52 and the circulating fan 42, and is then blown to the drying duct 43. While passing through the drying duct 43, the low-humidity air is heated by the heater 42. As a result, the low-humidity air is changed into high-temperature and low-humidity air.

The high-temperature and low-humidity air passes through the tub 50, and is then supplied into the drum 20. Thereafter, the above-described drying, condensing, and heating actions are repeated to continuously dry the laundry m.

The condensed water (not shown), which is condensed on the surface of the condensing plate 70, flows downward along the condensing plate 70, and is then drained out of the washing-drying/drying machine together with the cooling water C collected in the inner lower part of the tub 50.

Figure 3B:
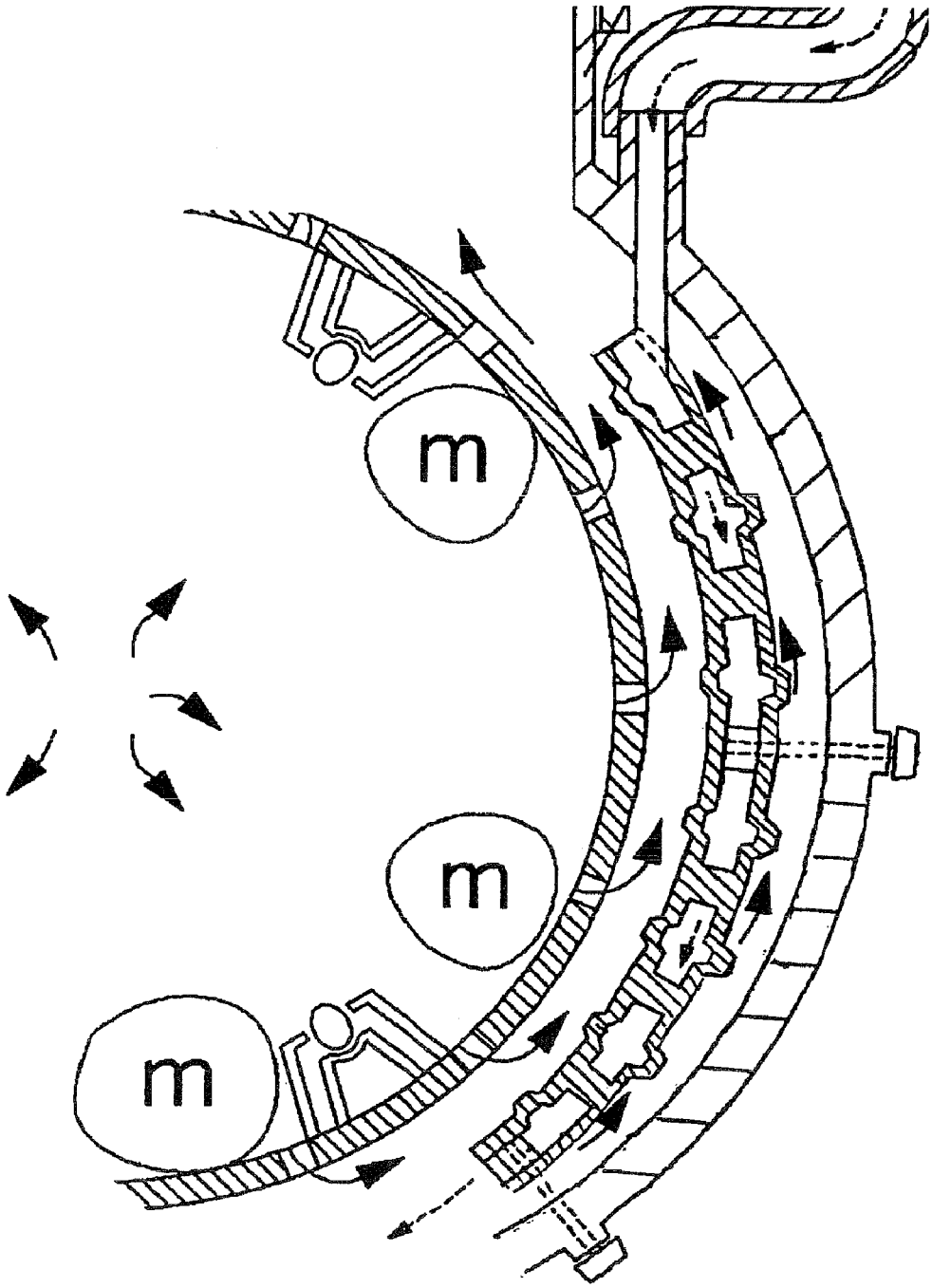
FIG. 3B is a partially cross-sectional view of the washing-drying/drying machine according another preferred embodiment of the present invention

In another embodiment shown in FIG. 3B, the condensing plate 70 is mounted between the mounted between the drum and an inner wall of the tub for receiving the cooling water to condense the moisture in the air at both sides of the condensing plate 70. In this embodiment, the condensing plate 70 includes a first side surface facing the drum 20, and a second side surface facing the inner wall of the tub 50 covering the back side of the condensing plate 70. The cooling water flows into the condensing plate 70 between the first side surface and the second side surface. The air discharged from the drum 20 can pass between the drum 20 and the first side surface of the condensing plate 70 and/or between the inner wall of the tub 50 and the second side surface of the condensing plate 70. Therefore, the moisture in the air can be condensed at both sides of the condensing plate 70 to further increase the condensing efficiency.

The structure of the condensing plate 70 shown in FIG. 3B is very similar to that of the condensing plate 70 shown in FIGS. 3A and 5. One difference is that an additional plate is used to cover the back side of the of the condensing plate 70 and provides the second side surface facing the inner wall of the tub 50. The additional plate may have a similar structure as the main body of the condensing plate 70 shown in FIG. 3A, such as bosses 80, embossed parts 78, etc.

In addition, similar to the embodiment in FIG. 3A, the condensing plate 70 shown in FIG. 3B may include the cooling water guide members 76 and 77 between the first side surface and the second side surface as shown in FIG. 5. The cooling water is drained out of the condensing plate 70 after guided by the cooling water guide members 76 and 77. Also, the condensing plate 70 itself may have a free falling structure or a surface tension utilizing structure based on the gap between the first and second surfaces (see Equation 1 above), as mentioned above.

As apparent from the above description, the washing-drying/drying machine of the illustrated embodiments has the following advantages.

First, the cooling water supply unit is mounted at one side of the tub for supplying the cooling water to the tub. The condensing plate, which is cooled by the cooling water, is mounted at the inner wall of the tub. The moisture in the air used to dry the laundry is condensed in the tub by the condensing plate. Consequently, it is unnecessary to mount an additional condensing duct at the outside of the tub. Therefore, the capacities of the tub and the drum are increased or the overall size of the washing-drying/drying machine is decreased. Furthermore, the flow resistance of the air used to dry the laundry is minimized. Therefore, the drying efficiency of the washing-drying/drying machine is improved while drying time is reduced.

Second, the air used to dry the laundry comes into contact with the condensing plate, which has a predetermined surface area. As a result, the moisture in the air is condensed. Consequently, a large amount of moisture is quickly condensed, and consumption of the cooling water is minimized.

Third, the front and rear ends of the condensing plate are bent such that front and rear ends of the condensing plate are disposed in contact with the inner wall of the tub. As a result, the cooling water supplied between the condensing plate and the inner wall of the tub is not mixed with air flowing in the tub. Therefore, the cooling water is not dispersed. Consequently, poor drying efficiency, which may be caused when the cooling water is dispersed, is effectively prevented.

Fourth, the condensing plate is provided with the bosses, through which the corresponding screws are threadedly inserted. Consequently, the condensing plate is easily and securely fixed to the tub.

Fifth, the cooling water supplied to one side of the tub freely falls between the condensing plate and the inner wall of the tub. Consequently, a large amount of cooling water rapidly passes between the condensing plate and the inner wall of the tub. Therefore, the moisture contained in the air is quickly condensed.

Sixth, the cooling water supplied to one side of the tub is collected between the condensing plate and the inner wall of the tub due to surface tension. As a result, the cooling water can be kept on the condensing plate longer. Therefore, consumption of the cooling water is minimized.

Seventh, the condensing plate is provided with the cooling water guide members, which serve to guide the cooling water in a serpentine fashion between the condensing plate and the inner wall of the tub. As a result, the entire condensing plate is cooled by the cooling water. Consequently, the moisture is uniformly condensed on the entire surface of the condensing plate, and the moisture is more quickly condensed.

Eighth, the condensing plate is provided with the embossed parts. Consequently, the heat transfer efficiency of the condensing plate is increased, and therefore, a large amount of moisture is quickly condensed.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A washing-drying/drying machine comprising:

a heater to heat air to hot air;

a rotatable drum in which laundry is to be placed;

a tub having an inlet and an outlet to allow the hot air to flow in and out, the tub having a water supply hole;

a duct connected to the inlet and outlet of the tub to circulate the hot air from the outlet to the inlet; and a plate attached to an inner circumferential surface of the tub, wherein the water supply hole is positioned such that water flows between the plate and the inner circumferential surface of the tub and the plate is positioned such that the hot air is condensed by flowing between the plate and the drum, and wherein the plate includes a plurality of flow guides that protrude from a surface of the plate, at least one first flow guide declines from a front side of the plate toward the rear side of the plate at a first prescribed angle and at least one second flow guide declines from the rear side of the plate toward the front side of the plate at a second prescribed angle, and wherein the first and second flow guides are alternately arranged in a manner to form a water flow of a zigzag pattern.

2. The drying machine/washing-drying machine of claim 1, wherein the gap between the plate and the drum is such that the drum does not contact the plate when the drum rotated at a high speed during a spin-drying cycle.

3. The drying machine/washing-drying machine of claim 1, wherein the plate has a flow passage formed thereon for the cooling water.

4. The drying machine/washing-drying machine of claim 3, wherein the flow passage includes protruded portions which protrude toward the inner circumferential surface of the tub.

5. The drying machine/washing-drying machine of claim 4, wherein the protruded portions reach the inner circumferential surface of the tub.

6. The drying machine/washing-drying machine of claim 4, wherein the flow passage has a zigzag shape.

7. The drying machine/washing-drying machine of claim 4, wherein the plate has embossed portions on a surface facing the drum.

8. The drying machine/washing-drying machine of claim 1, wherein the gap between the plate and the inner circumferential surface of the tub at a flow passage for the cooling water is configured such that the cooling water flows by free-falling.

9. The drying machine/washing-drying machine of claim 1, wherein the gap between the plate and the inner circumferential surface of the tub at a flow passage for the cooling water is configured such that the cooling water is held by surface tension of the water.

10. The drying machine/washing-drying machine of claim 1, wherein both opposite edges of the plate are bent toward the inner circumferential surface of the tub.

11. The drying machine/washing-drying machine of claim 1, wherein the plate is attached to a left or right inner circumferential surface of the tub.

12. The drying machine/washing-drying machine of claim 11, wherein the outlet of the tub is located over the plate.

13. The drying machine/washing-drying machine of claim 1, wherein the inlet is formed on a portion which is extended forward from a front surface of the tub.

14. The drying machine/washing-drying machine of claim 1, wherein the outlet is formed to protrude from an outer surface of the tub.

15. The drying machine/washing-drying machine of claim 1, wherein the outlet formed such that the hot air is discharged in a tangential direction relative to an outer circumferential surface of the tub.

16. The drying machine/washing-drying machine of claim 1, wherein the inlet and the outlet are formed such that flow directions of the hot air are parallel to each other.

17. The drying machine/washing-drying machine of claim 1, wherein the inlet is located at a front upper portion of the tub and the outlet is located at a rear upper portion of the tub.

* * * * *